US006752554B1

(12) United States Patent
Brittingham

(10) Patent No.: US 6,752,554 B1
(45) Date of Patent: Jun. 22, 2004

(54) MOBILE DOCUMENT HANDLING SYSTEM

(76) Inventor: Milord C. Brittingham, 3324 X St. #1, Sacramento, CA (US) 95817

( * ) Notice: Subject to any disclaimer, the term of this patent is extended or adjusted under 35 U.S.C. 154(b) by 0 days.

(21) Appl. No.: 10/122,919

(22) Filed: Apr. 12, 2002

(51) Int. Cl.[7] ..... B41J 29/02

(52) U.S. Cl. ..... 400/693; 400/88; 400/578; 358/496; 358/498

(58) Field of Search ..... 400/88, 578, 693; 358/400, 496, 498

(56) References Cited

U.S. PATENT DOCUMENTS 5,276,527 A * 1/1994 Sugiyama et al. ..... 358/296
5,305,183 A * 4/1994 Teynor ..... 361/686
5,312,196 A 5/1994 Hock et al.
5,345,403 A * 9/1994 Ogawa et al. ..... 361/681
D353,154 S 12/1994 Suzuki
5,387,043 A 2/1995 Fujioka et al.
5,391,009 A * 2/1995 Stodder ..... 400/605
5,484,991 A 1/1996 Sherman et al.
5,790,279 A * 8/1998 Sakellaropoulos ..... 358/498
5,896,206 A * 4/1999 Kellogg ..... 358/498
5,988,900 A * 11/1999 Bobry ..... 400/88
6,015,211 A 1/2000 Kinoshita et al.
6,069,711 A 5/2000 Iwata

* cited by examiner

*Primary Examiner*—Daniel J. Colilla
*Assistant Examiner*—Jill E. Culler

(57) ABSTRACT

A mobile document handling system includes a mobile document handling system for use with a laptop computer that includes a main housing portion that has a bottom wall designed for resting on a horizontal support surface such as a table. The main housing portion defines an interior space. A input slot is positioned adjacent to a first edge of the main housing portion. The input slot is for selectively receiving at least one sheet of paper. A printing means is operationally couplable to the laptop computer. The printing means is for printing a graphic representation of information from the laptop computer onto the paper. An output slot is positioned adjacent to a second edge of the main housing portion. The output slot is for facilitating egress of the paper from the system after printing.

1 Claim, 3 Drawing Sheets

MOBILE DOCUMENT HANDLING SYSTEM

BACKGROUND OF THE INVENTION

1. Field of the Invention

The present invention relates to document handling systems and more particularly pertains to a new mobile document handling system for providing a user with a fax machine, printer, and scanner in a compact mobile package.

2. Description of the Prior Art

The use of document handling systems is known in the prior art. U.S. Pat. No. 6,069,711 describes a portable printer/facsimile device. Another type of document handling system is U.S. Pat. No. 6,015,211 describing a portable printing device with shutter for covering a print head. U.S. Pat. No. 5,312,196 describes a portable printer and sheet feeder which can be battery powered. U.S. Pat. No. 5,484,991 describes a portable modular workstation including a printer and a portable data collection terminal. U.S. Pat. No. 5,387,043 describes a compact printer. U.S. Pat. No. Des. 353,154 describes an ornamental design for a laser printer.

While these devices fulfill their respective, particular objectives and requirements, the need remains for a device that is compact and portable allowing the user to adequately handle documents.

SUMMARY OF THE INVENTION

The present invention meets the needs presented above by incorporating a scanner, printer, and fax machine into a small portable compact unit.

Still yet another object of the present invention is to provide a new mobile document handling system that would be compatible with all major laptop brands via a universal serial bus interface.

Even still another object of the present invention is to provide a new mobile document handling system that would allow the mobile user a fully functional portable office.

To this end, the present invention generally comprises a mobile document handling system for use with a laptop computer that includes a main housing portion that has a bottom wall designed for resting on a horizontal support surface such as a table. The main housing portion has a top wall. The main housing portion has a perimeter wall that extends upwardly from the bottom wall to the top wall. The main housing portion defines an interior space. A input slot is positioned adjacent to a first edge of the main housing portion. The input slot is for selectively receiving at least one sheet of paper. A printing means is operationally couplable to the laptop computer. The printing means is for printing a graphic representation of information from the laptop computer onto the paper. An output slot is positioned adjacent to a second edge of the main housing portion. The output slot is for facilitating egress of the paper from the system after printing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
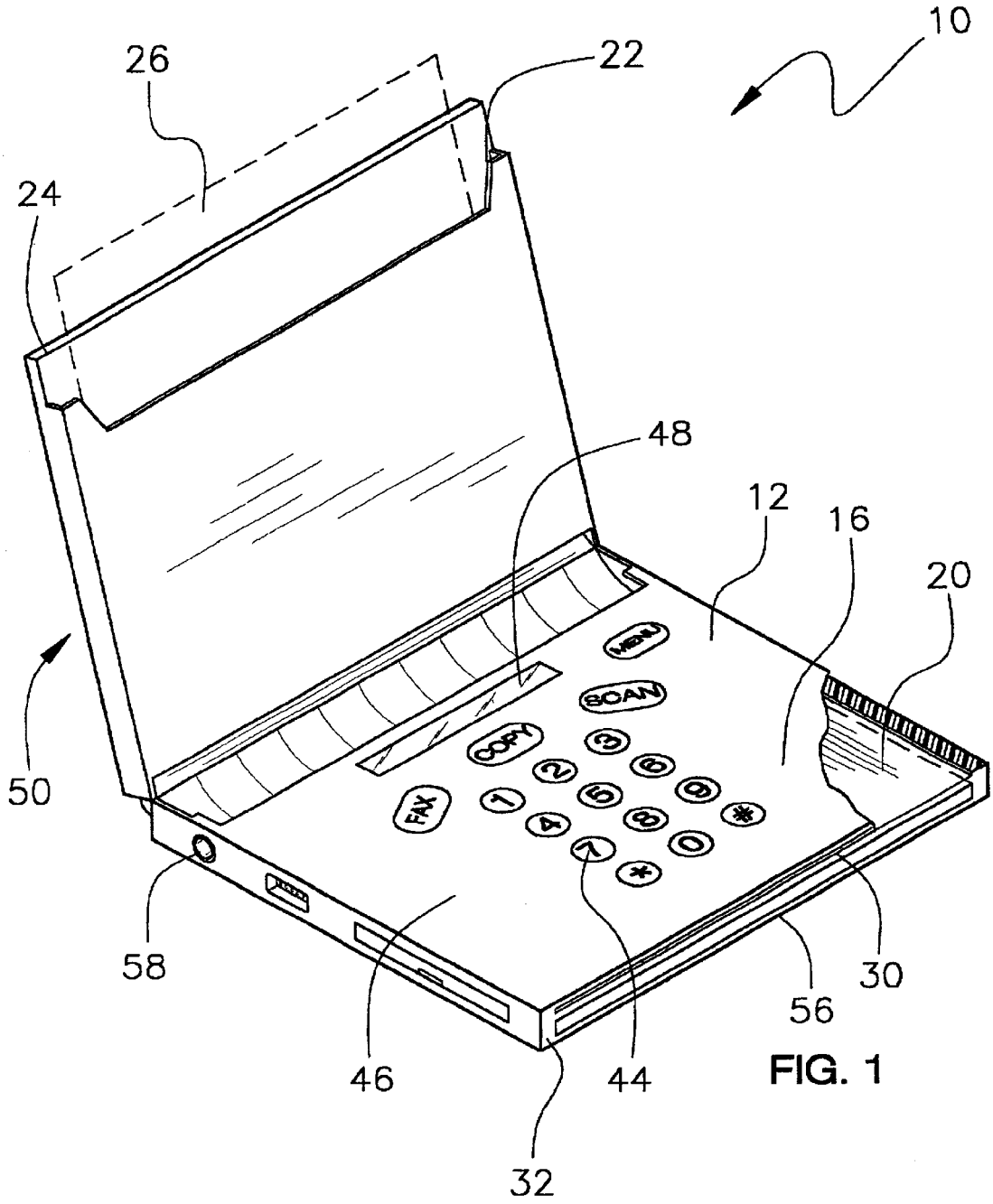
FIG. 1 is a perspective view of a new mobile document handling system according to the present invention.
Figures 2, 3:
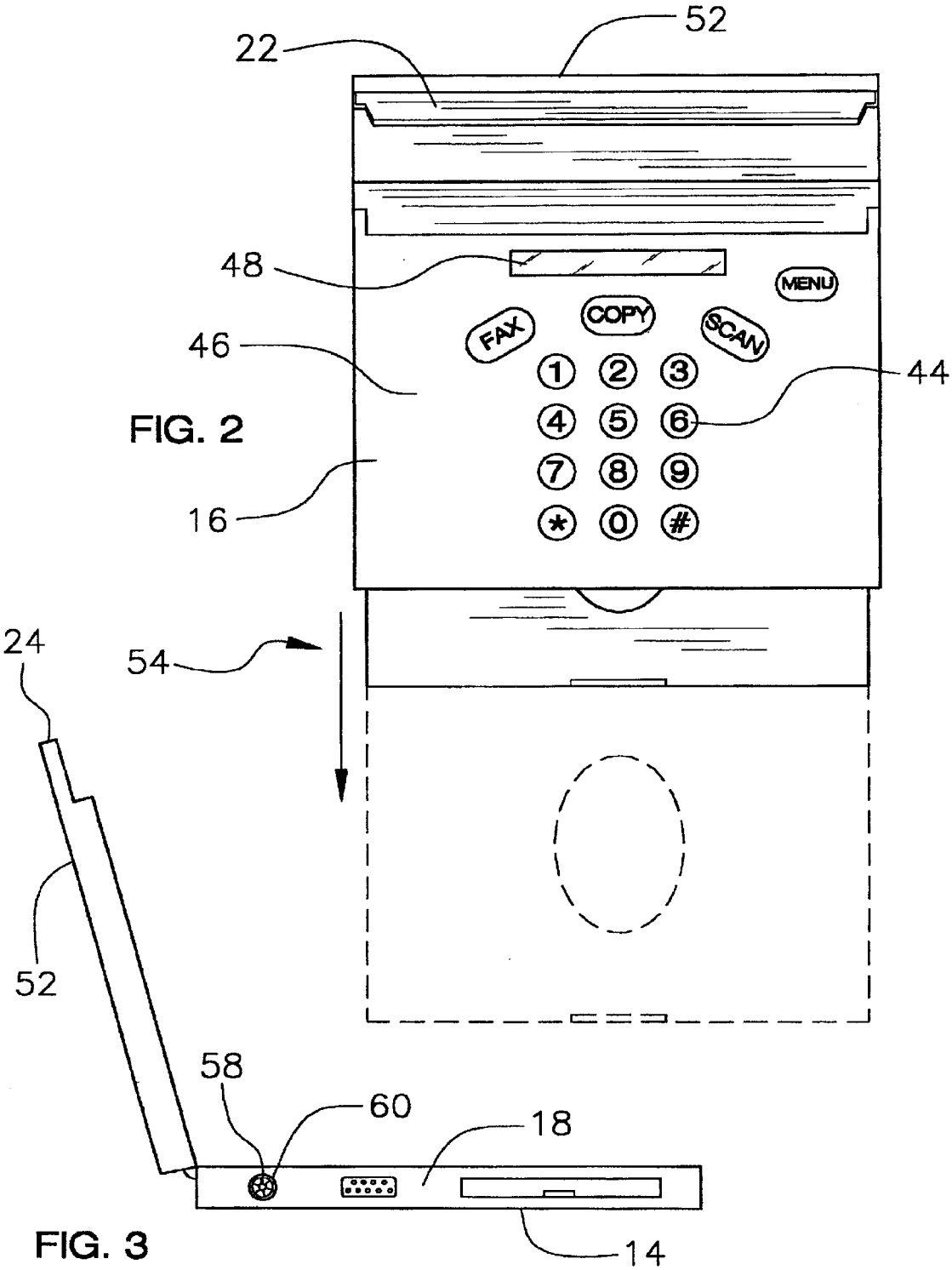
FIG. 2 is a top view of the present invention.
FIG. 3 is a side view of the present invention.
Figure 4:
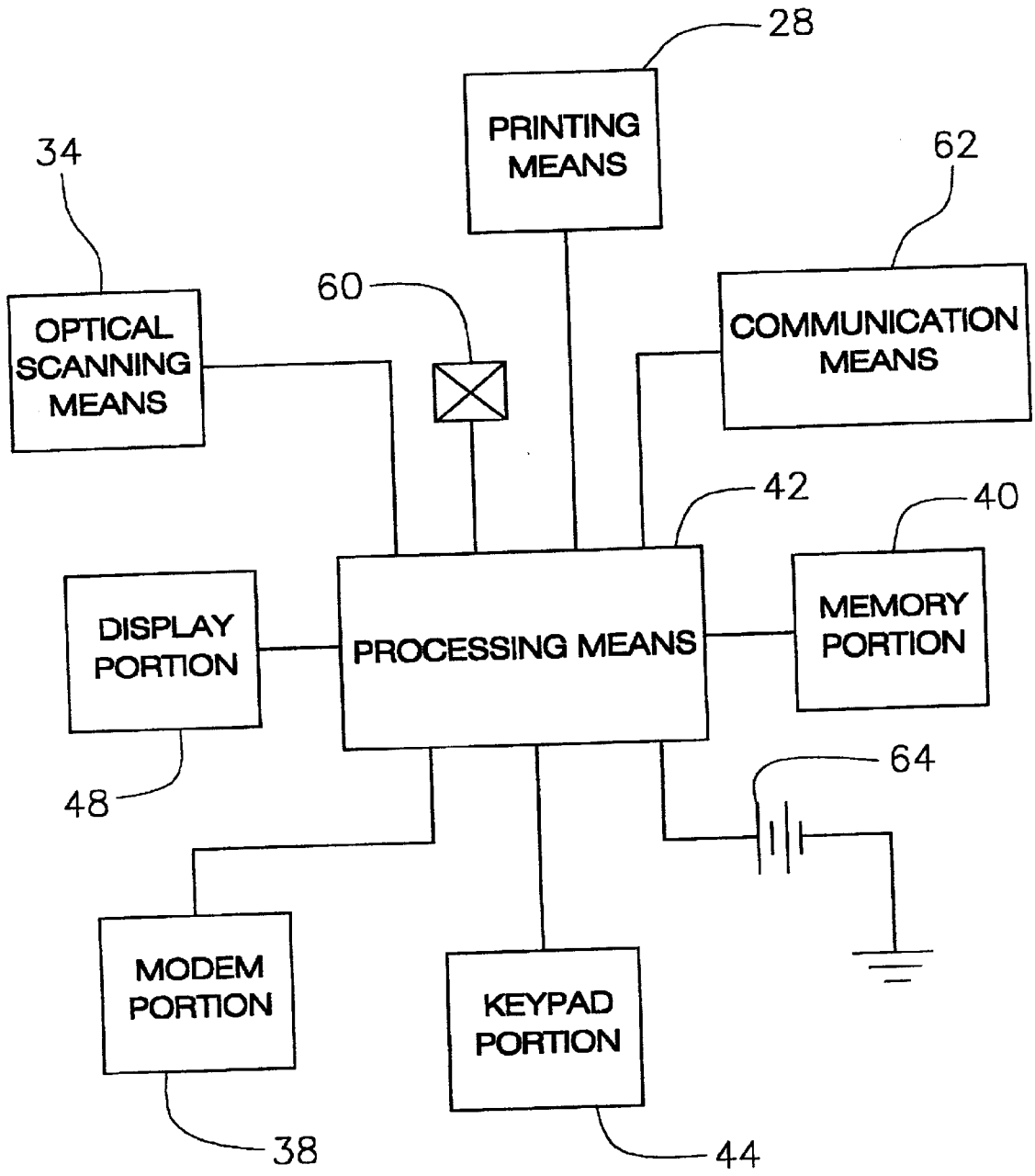
FIG. 4 is a block-diagram view of the present invention.

With reference now to the drawings, and in particular to FIGS. 1 through 4 thereof, a new mobile document handling system embodying the principles and concepts of the present invention and generally designated by the reference numeral 10 will be described.

As best illustrated in FIGS. 1 through 4, the mobile document handling system 10 generally comprises a main housing portion 12 that has a bottom wall 14 designed for resting on a horizontal support surface such as a table. The main housing portion 12 has a top wall 16. The main housing portion 12 has a perimeter wall 18 that extends upwardly from the bottom wall 14 to the top wall 16. The main housing portion 12 defines an interior space 20. A input slot 22 is positioned adjacent to a first edge 24 of the main housing portion 12. The input slot 22 is for selectively receiving at least one sheet of paper 26. A printing means 28 is operationally couplable to the laptop computer. The printing means 28 is for printing a graphic representation of information from the laptop computer onto the paper 26. An output slot 30 is positioned adjacent to a second edge 32 of the main housing portion 12. The output slot 30 is for facilitating egress of the paper from the system after printing.

An optical scanning means 34 is positioned substantially within the main housing portion 12. The optical scanning means 34 is positioned adjacent to the input slot 22 such that a printed page inserted into the input slot 22 is scannable by the scanning means 34 whereby graphical information from the page is captures. A modem portion 38 is positioned substantially within the main housing portion 12. The modem portion 38 is operationally coupled to the scanning means 34 such that graphical information from the page is transmittable via the modem portion 38 to a remote user. A memory portion 40 is for storing information to be interchanged with the laptop computer. The memory portion 40 facilitates storage of a representation of graphical information and commands from the user. The memory portion 40 is positioned substantially within the main housing portion 12. A processing means 42 is for manipulating the representation of graphical information based upon the commands. The processing means 42 is operationally coupled to the memory portion 40. The processing means 42 is positioned substantially within the main housing portion 12.

A keypad portion 44 is positioned on a top surface 46 of the main housing portion 12. The keypad portion 44 facilitates the user input of command information. A display portion 48 is positioned on a top surface 46 of the main housing portion 12. The display portion 48 provides a visual indicia of command information and system status.

A document feeding assembly 50 is pivotally coupled to the main housing portion 12. The document feeding assembly 50 is alignable with the input slot 22 such that papers 26 positioned in the document feeding assembly 50 are fed into the input slot 22 as required. The document feeding assembly 50 has a closed position defined by a first surface 52 of the document feeding assembly 50 abutting a top surface 46 of the main housing portion 12. The document feeding assembly 50 is covering the top surface 46 during storage and transportation of the system.

A sliding paper tray assembly 54 is positionable within the main housing portion 12. The sliding paper tray assembly 54 is extendable from the main housing portion 12. The sliding paper tray 54 is positioned adjacent to a lower edge 56 of the output slot 30. The sliding paper tray 54 facilitating out-feeding of the paper 26 after printing.

The main housing portion 12 has at least one ventilation aperture 58 that extends through the perimeter wall 18. The ventilation aperture 58 facilitates airflow through the main housing portion 12. A ventilation fan 60 is positioned substantially within the main housing portion 12. The ventilation fan 60 is positioned substantially adjacent to the ventilation aperture 58. The ventilation fan 60 urges air through the main housing portion 12. The ventilation fan 60 facilitates cooling of the interior space 20.

A communication means 62 is operationally coupled to the processing means 42. The communication means 62 facilitates two-way communication between the system 10 and the laptop computer. The two-way communication includes a representation of graphical information, command information, and status information. The communication means 62 includes a communications port selected from the list of communications ports consisting of parallel, serial, universal serial bus, infra-red, and rf.

The printing means 28 includes a printer selected from the group of printers consisting of thermal, inkjet, laser, and impact.

An electrical energy storage means 64 is operationally coupled to the processing means 42, modem 38, printing means 28, and optical scanning 34 means. The electrical energy storage means 64 provides electrical energy for the system. The electrical energy storage means 64 is positioned substantially within the housing 12.

In use, a user would connect the present invention to a computer via an communication interface cable. The present invention would perform all the functions that a separate scanner, fax, and printer could perform.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mobile document handling system for use with a laptop computer, comprising:

a main housing portion having a bottom wall adapted for resting on a horizontal support surface such as a table, said main housing portion having a top wall, said main housing portion having a perimeter wall extending upwardly from said bottom wall to said top wall, said main housing portion defining an interior space, said interior space of said main housing portion defining a second portion of a paper path;

a printing means operationally couplable to the laptop computer for at least receiving one-way communication from the laptop computer, said printing means being for printing a graphic representation of information from the laptop computer onto the paper;

an output slot positioned adjacent to a second edge of said main housing portion, said output slot being for facilitating egress of the paper from said system after printing;

a sliding paper tray assembly being positionable within said main housing portion, said sliding paper tray assembly being extendable from said main housing portion, said sliding paper tray being positioned adjacent to a lower edge of said output slot, said sliding paper tray facilitating out-feeding of the paper after printing;

an optical scanning means positioned substantially within said main housing portion, said optical scanning means positioned adjacent to an input slot such that a printed page inserted into said input slot is scannable by said scanning means whereby graphical information from the page is captured;

a modem portion positioned substantially within said main housing portion, said modem portion being operationally coupled to said scanning means such that graphical information from the page is transmittable via said modem portion to a remote user;

a memory portion for storing information to be interchanged with the laptop, computer, said memory portion facilitating storage of a representation of graphical information and commands from the user, said memory portion being positioned substantially within said main housing portion; and a processing means for manipulating said representation of graphical information based upon said commands, said processing means being operationally coupled to said memory portion, said processing means being positioned substantially within said main housing portion;

a keypad portion positioned on a top surface of said main housing portion, said keypad portion facilitating user input of command information; and a display portion positioned on a top surface of said main housing portion, said display portion providing a visual indicia of command information and system status;

a document feeding assembly pivotally coupled to said main housing portion in a clamshell relationship, said document feeding assembly forming a channel defining a first portion of said paper path, said document feeding assembly associated with said input slot and defining an intermediate exit slot in communication with said first portion of said paper path, said document feeding assembly being formed of walls extending substantially continuously between said input slot and said intermediate slot such that said channel of said document feeding assembly is closed between said input slot and said intermediate exit slot, said document feeding assembly being alignable with an intermediate paper receiving slot in said main housing such that papers positioned in said paper path of said document feeding assembly are fed into said intermediate paper-receiving slot as required; and said document feeding assembly being pivotable between a closed position and an open position, said closed position being characterized by a first surface of said document feeding assembly abutting a top surface of said main housing portion such that said document feeding assembly covers said top surface during storage and transportation of said system, said open position of said document feeding assembly being characterized by said document feeding assembly being pivoted away from said top surface of said main housing such that said first portion of said paper path through said document feeding assembly is oriented generally perpendicular to said second portion of said paper path in said main housing;

a sliding paper tray assembly being positionable within said main housing portion, said sliding paper tray assembly being extendable from said main housing portion, said sliding paper tray being positioned adjacent to a lower edge of said output slot, said sliding paper tray facilitating out-feeding of the paper after printing;

said main housing portion having at least one ventilation aperture extending through said perimeter wall, said ventilation aperture facilitating airflow through said main housing portion; and a ventilation fan positioned substantially within said main housing portion, said ventilation fan being positioned substantially adjacent to said ventilation aperture, said ventilation fan urging air through said main housing portion, said ventilation fan facilitating cooling of said interior space;

a communication means operationally coupled to said processing means, said communication means facilitating two-way communication between said system and the laptop computer, said two-way communication comprising a representation of graphical information, command information, and status information;

said communication means comprises a communications port selected from the list of communications ports consisting of parallel, serial, universal serial bus, infrared, and rf;

a printing means comprises a printer selected from the group of printers consisting of thermal, inkjet, laser, and impact; and an electrical energy storage means operationally coupled to said processing means, modem, printing means, and optical scanning means, said electrical energy storage means providing electrical energy for said system, said electrical energy storage means being positioned substantially within said housing.

* * * * *